US005476328A

United States Patent [19]

Hori

[11] Patent Number: 5,476,328

[45] Date of Patent: Dec. 19, 1995

[54] AUTOMATIC PLATEN GAP ADJUSTING DEVICE FOR PRINTER

[75] Inventor: Takashi Hori, Nagano, Japan

[73] Assignee: Seiko Epson Corporation, Tokyo, Japan

[21] Appl. No.: 352,623

[22] Filed: Dec. 9, 1994

[30] Foreign Application Priority Data

Dec. 9, 1993 [JP] Japan ..... 5-341311

[51] Int. Cl.[6] ..... B41J 11/20

[52] U.S. Cl. ..... 400/56; 400/59

[58] Field of Search ..... 400/55, 56, 59

[56] References Cited

U.S. PATENT DOCUMENTS

| | | | |
|---|---|---|---|
| 4,652,153 | 3/1987 | Kotsuzumi et al. | 400/59 |
| 4,812,059 | 3/1989 | Masaki | 400/59 |
| 4,974,974 | 12/1990 | Yoshida et al. | 400/56 |
| 4,990,004 | 2/1991 | Kawahara et al. | 400/56 |
| 5,088,843 | 2/1992 | Hori | 400/59 |
| 5,133,611 | 7/1992 | Nakajima | 400/56 |
| 5,156,465 | 10/1992 | Kakiuchi | 400/56 |
| 5,156,466 | 10/1992 | Inagaki et al. | 400/56 |
| 5,257,867 | 11/1993 | Ito et al. | 400/56 |

FOREIGN PATENT DOCUMENTS

| | | | |
|---|---|---|---|
| 63-137869 | 6/1988 | Japan | B41J 13/00 |
| 414634 | 3/1992 | Japan | B41J 25/308 |

*Primary Examiner*—Eugene H. Eickholt

*Attorney, Agent, or Firm*—Sughrue, Mion, Zinn, Macpeak & Seas

[57] ABSTRACT

An automatic platen gap adjusting device for a printer for automatically adjusting a relative gap length between a platen and a recording head, and for checking whether the recording head and a recording sheet are in contact after the adjustment. The device includes a carriage motor for driving a carriage having a recording head, load detection means for detecting a load from a load current of the carriage motor when the carriage is moved in parallel with the platen shaft, initial load storage means for storing an initial load before the recording sheet is loaded, contact judgment means for comparing the load when the recording sheet is loaded and the initial load, and for judging whether the recording head contacts the recording sheet when a difference between these loads exceeds a preset value, a stepper motor for moving the carriage orthogonal to the platen shaft, an encoder for generating a number of pulse signals proportional to an amount of orthogonal movement of the carriage, abutment judgment means for moving the carriage toward the platen from a reference position and for judging the time to abutment, sheet thickness calculation means for calculating the thickness of the recording sheet, and control means that adjusts the platen gap based on the detected sheet thickness.

14 Claims, 5 Drawing Sheets

AUTOMATIC PLATEN GAP ADJUSTING DEVICE FOR PRINTER

BACKGROUND OF THE INVENTION

1. Field of the Invention

This invention relates to devices for automatically adjusting a gap between a platen and a recording head in accordance with the thickness of a recording sheet. More particularly, the invention is directed to devices for adjusting the gap to an optimal value by judging the thickness of a loaded recording sheet.

2. Description of the Related Art

In a recording head, and particularly a wire dot type recording head that prints data by impinging wires onto a recording sheet through an ink ribbon, a wire impinging speed must be minimized in order to achieve high speed printing.

Since the wire dot type recording head is mechanically rigid and capable of copying data through a copying material, the recording head can be used with a wide variety of different types of sheets. This feature is problematic, however, because the distance between the recording head and the recording sheet varies by a greater degree than in printers of other types.

To overcome this problem, a printer using a wire dot type recording head usually has a mechanism for adjusting a relative gap length between the platen and the recording head. However, the user must be well skilled in selecting the optimal gap for each kind of sheet used, and the selecting operation is cumbersome.

The printer disclosed in Japanese Examined Patent Publication No. 4-14634 is intended to overcome the above noted problems. This printer has an encoder that generates pulse signals in association with the movement of the carriage from an initial position thereof, and a control section that processes a feedback pulse signal from the encoder. The first instance of a carriage-driving pulse motor losing synchronism is detected from a change in the number of pulses from the encoder due to an abutment of the recording head against a recording sheet, and the thickness of the recording sheet is calculated based on the amount of movement of the carriage up to the moment of abutment, so that the position of the carriage can be controlled based on the recording sheet thickness data.

Although the platen gap is adjusted as described above, unsatisfactory contact between the recording sheet and the platen causes the recording head and the ink ribbon to come in contact with the recording sheet, possibly causing problems such as breakage and staining of the recording head.

SUMMARY OF THE INVENTION

The invention has been made in consideration of the aforementioned problems, and the object of the invention is, therefore, to provide an automatic platen gap adjusting device capable of preventing the recording head from being broken or stained by not only measuring the thickness of a recording sheet by causing the carriage to come in pressure contact with the recording sheet with a sufficiently small force, but also by automatically judging the gap between the recording head and the recording sheet.

To achieve the above objects, the invention is applied to an automatic platen gap adjusting device for a printer, which includes: a carriage motor for driving a carriage in parallel with a platen shaft, the carriage carrying a recording head;

a means for detecting a load from a load current of the carriage motor when the carriage is moved in parallel with the platen shaft at a predetermined speed; an initial load storage means for storing the load at the time a recording sheet is not loaded as an initial load; a contact judgment means for comparing the load at the time the recording sheet is loaded with the initial load and judging that the recording head is in contact with the recording sheet when a difference between both loads exceeds a reference value; a stepper motor for moving the carriage in direction orthogonal to the platen shaft; a movement amount detection means for generating a number of pulse signals proportional to an amount of movement of the carriage in the direction orthogonal to the platen shaft; an abutment judgment means for moving the carriage toward a platen from a reference position, integrating time differences between respective drive pulses of the stepper motor and corresponding pulse signals generated from the movement amount detection as a result of the drive of the stepper motor by the drive pulses, and judging that the integrated value of the time differences has reached a predetermined value; a sheet thickness calculation means for calculating a thickness of a recording sheet based on the amount of movement of the carriage from the reference position upon output of a signal from the abutment judgment means; and a control means for adjusting a relative gap length between the carriage and the platen by driving the stepper motor based on data from the sheet thickness calculation means.

While counting the amount of movement of the carriage toward the platen from the reference position, a time difference between the stepper motor drive pulse and the pulse signal from the movement detection means is detected. When the integrated value of the time differences has reached a preset value and at a stage before losing synchronism, abutment of the recording head against the recording sheet is judged, and the thickness of the recording sheet is calculated from the amount of movement of the carriage up to the moment of abutment. As a result of the calculation, the relative gap length between the platen and the carriage is set to an optimal value.

Next, a load applied to the carriage motor and a load with no recording sheet loaded are compared with each other by moving the carriage in the main scanning direction after the platen gap has been adjusted in order to check that the recording head is not in contact with the recording sheet.

BRIEF DESCRIPTION OF THE DRAWING FIGURES

The preferred embodiments of the invention are described in detail below with reference to the accompanying drawings, in which.

DETAILED DESCRIPTION OF THE PREFERRED EMBODIMENTS

Figure 1A:
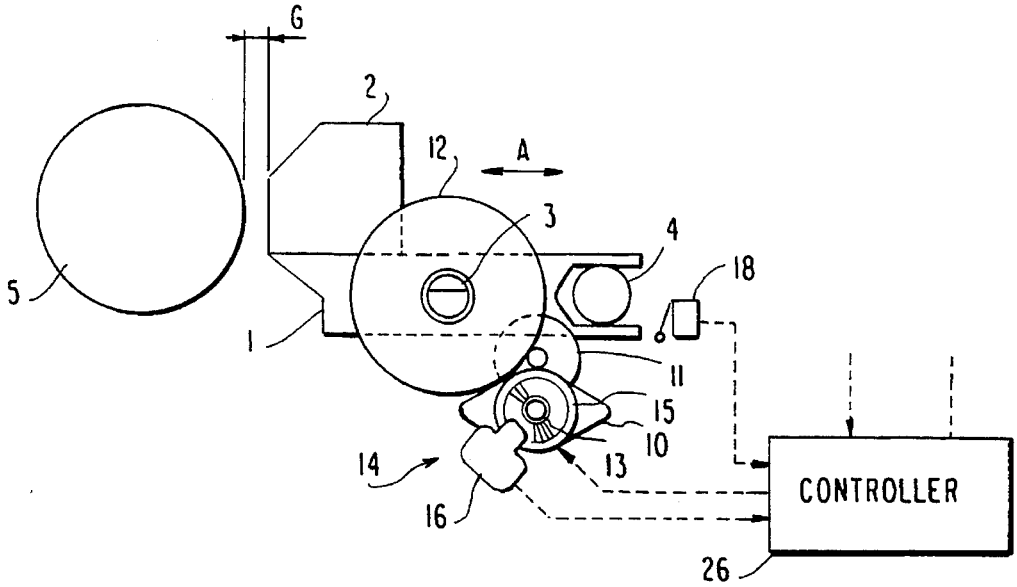
FIG. 1(A) is an end view and diagram of an embodiment of a carriage drive mechanism of a serial printer to which the invention is applied.
Figure 1B:
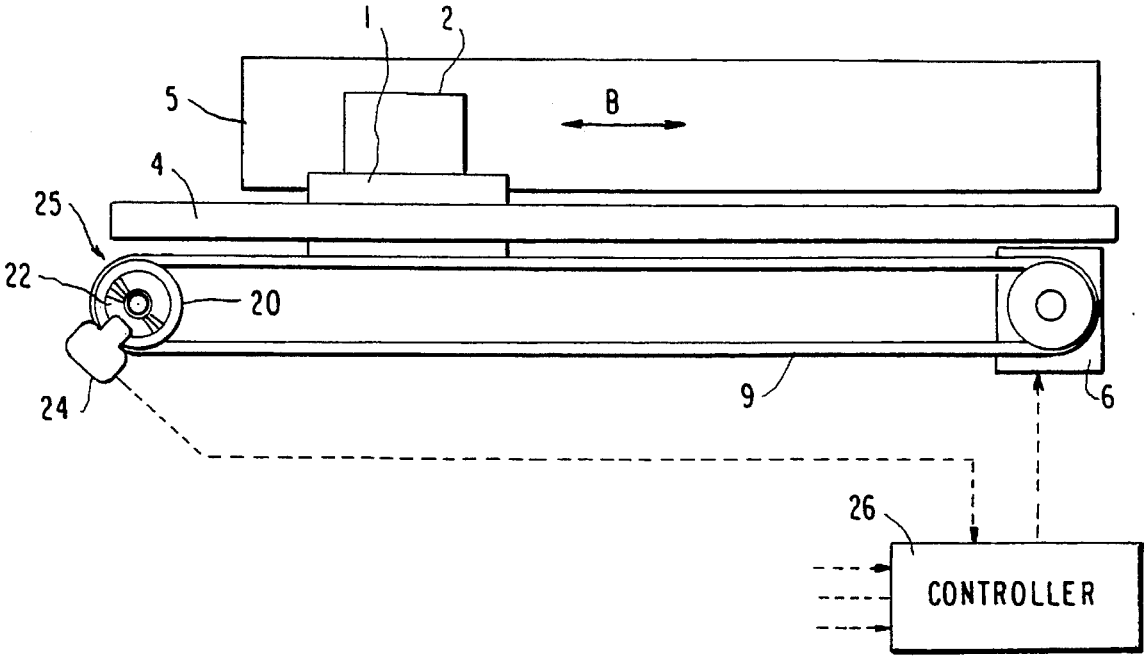
FIG. 1(B) is view orthogonal to the end view of the embodiment in FIG. 1(A) of another feature of the carriage drive mechanism shown in FIG. 1(A)

FIGS. 1(A) and 1(B) are different views of an embodiment of a mechanism for adjusting a relative gap length between the platen and the recording head of a serial printer to which the invention is applied. In these figures, reference numeral 1 denotes a carriage having an impact wire type recording head 2 carried thereon and being disposed on a guide shaft 3 and a fixed guide shaft 4. The guide shaft 3 is mounted on a base so as to be eccentrically rotatable. The carriage 1 can move in directions indicated by the double ended arrow "A" in FIG. 1(A). As a result of this construction, a relative gap length "G" of the recording head 2 with respect to the platen 5 can be adjusted by the amount of rotation of the guide shaft 3. The carriage 1 is connected to a carriage motor 6, e.g., a dc motor, through a timing belt 9, so that the carriage 1 can shuttle in directions of the platen shaft indicated by the double ended arrow 'B" in FIG. 1(B) with the gap length "G" adjusted by the guide shaft 3.

Reference numeral 10 denotes a stepper motor that rotates the guide shaft 3. This stepper motor 10 drives the guide shaft 3 by 2-2 phase excitation and at a cycle of 3.5 ms, and is connected to a driven wheel 12 of the guide shaft 3 through a reduction gear 11. A shaft 13 of the stepper motor 10 carries a code disk 15 of a first encoder 14 that generates a pulse signal indicating a value proportional to the angle of rotation thereof. The code pattern of the code disk 15 is such that a single pulse width signal can be generated from a code detector 16 in synchronism with single phase drive of the stepper motor 10. Reference numeral 18 denotes a position detection means that is positioned so as to output a signal when the carriage 1 has reached a reference position at which the carriage 1 is farthest from the platen 5. A microswitch may be used as the position detection means in one preferred embodiment.

A second encoder 25 is provided to measure movement of the carriage 1 in the main scanning direction. The second encoder 25 comprises a code disk 22 fixed on an idler 20 of the timing belt 9 and a code detector 24 that detects a code indicated by the code disk.

Reference numeral 26 denotes a controller, which receives signals from the first and second encoders 14, 25 as well as from the position detector 18, and controls the carriage motor 6 and the stepper motor 10.

Figure 2:
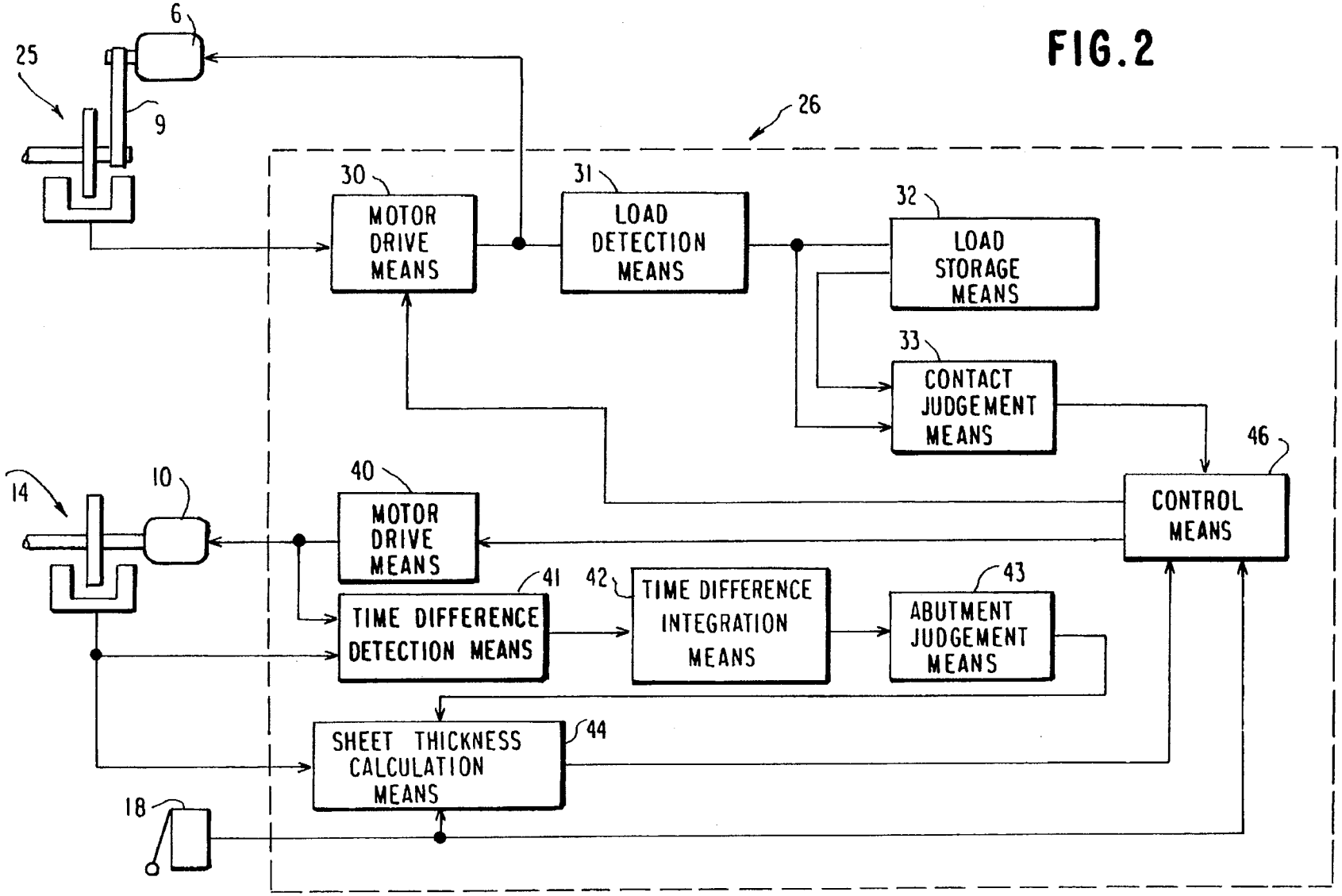
FIG. 2 is a diagram showing a configuration of an embodiment of the invention.

FIG. 2 shows an embodiment of the controller 26. In FIG. 2, reference numeral 30 denotes a motor drive means for driving the motor 6 that moves the carriage 1 in the main scanning direction. The motor drive means 30 is activated by a signal from a control means 46, judges the carriage 1 moving speed from a signal from the second encoder 25, and adjusts the duty of a current pulse to be supplied to the carriage motor 6 so that the carriage 1 moving speed becomes constant.

Reference numeral 31 denotes a load detection means, which detects a load applied to the carriage motor 6 based on the duty of the current pulse supplied to the carriage motor 6, and delivers the detected value to an initial load storage means 32 when no recording sheet is loaded. Reference numeral 33 denotes a contact judgment means, which calculates a difference between a signal from the load detection means 31 when the recording sheet is loaded and the value of the initial load storage means 32, compares the difference with a reference value, and judges whether the recording head 2 is in contact with the recording sheet when the difference exceeds the reference value.

Reference numeral 40 denotes a motor drive means, which drives the stepper motor 10 to move the carriage 1 in the direction orthogonal to the platen 5. Reference numeral 41 denotes a time difference detection means, which judges whether a time difference between the cycle of a pulse signal from the first encoder 14 and the cycle of a drive signal of the stepper motor 10 changes, and outputs an amount of change $\Delta Tn$ in the time difference when the time difference has changed. Reference numeral 42 denotes a time difference integration means, which calculates an integrated value $\Sigma$ ($\Delta Tn$) of the amounts of change $\Delta Tn$ in the time difference, and outputs the integrated value $\Sigma$ to an abutment judgment means 43, which will be described below.

Reference numeral 43 denotes the abutment judgment means, which outputs a signal upon coincidence of the integrated value of the amounts of change in the time difference from the time difference integration means 43 with a reference value. The reference value in this embodiment is a value half or less of the cycle of the drive pulse of the stepper motor 10, e.g., 1.5 ms.

Reference numeral 44 denotes a sheet thickness calculation means, which counts the number of pulse signals from the encoder 14 based on a signal from the position detector 18, stops counting in accordance with a signal from the abutment judgment means 43, and calculates the thickness of a recording sheet based on the pulse signal count.

Reference numeral 46 denotes the control means, which not only controls the stepper motor 10 for adjusting the platen gap, but also effects a sequence control for checking that the recording sheet is not in contact with the recording head 2 after the platen gap has been adjusted. Specifically, the control means 46 drives the carriage motor 6 with no recording sheet being loaded, e.g., at the time a power switch is not turned on; sets the carriage 1 to the reference position thereof by causing the carriage 1 to retreat in such a direction as to move away from the platen 5 until a signal is outputted from the position detector 18 upon pressing of a loading switch (not shown); causes the carriage 1 to move toward the platen 5 to thereby cause the recording head 2 to be abutted against the recording sheet; drives the stepper motor 10 so that an optimal gap length is given to the loaded recording sheet after the thickness of the recording sheet has been detected; and finally drives the carriage motor 6 again after the platen gap has been adjusted.

Figure 3:
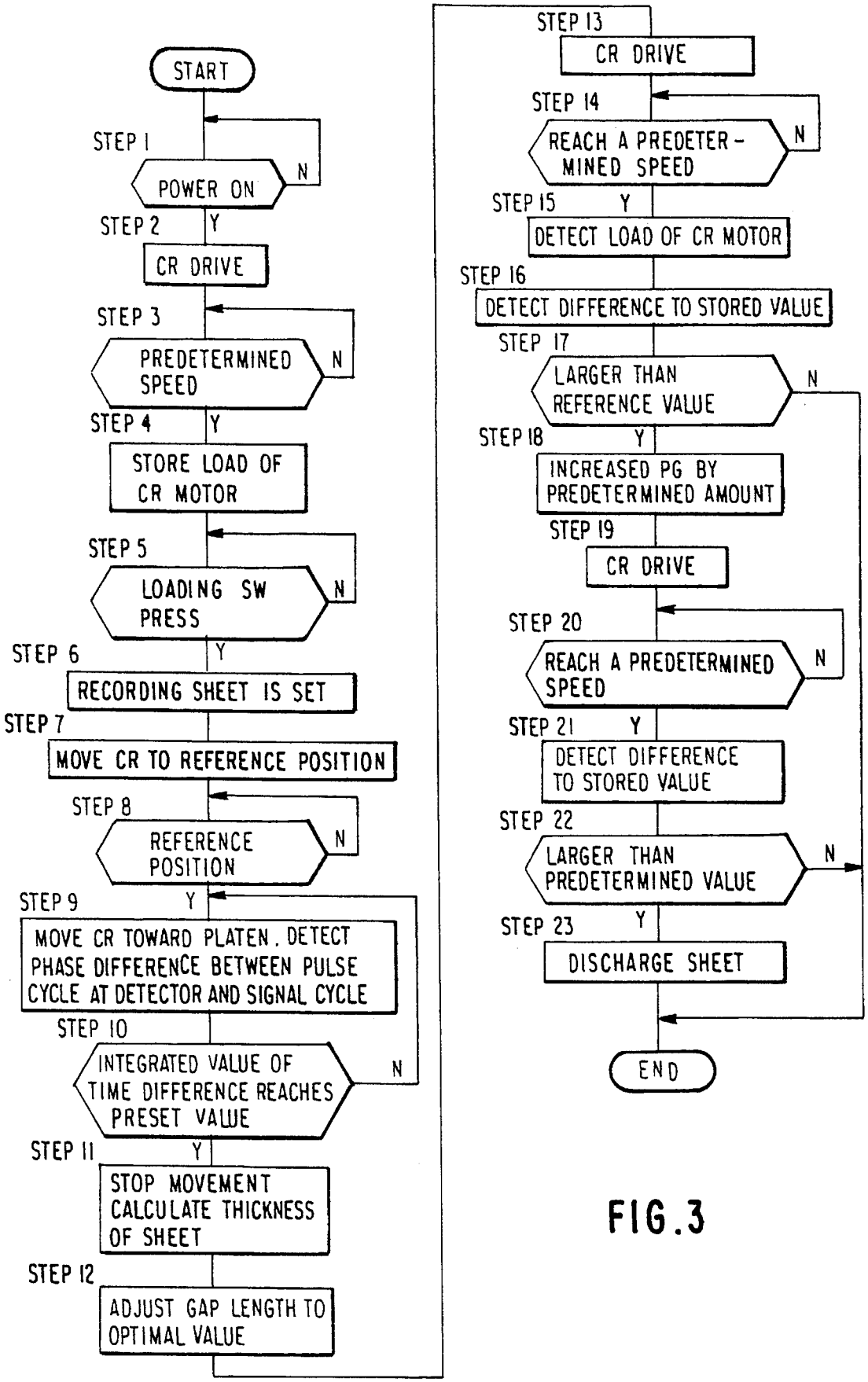
FIG. 3 is a flowchart showing a mode of operation of the embodiment shown in FIG. 2.

A mode of operation of the thus constructed device will be described next with reference to a flowchart shown in FIG. 3.

When a power switch (not shown) of a printer has been turned on (Step 1), the control means 46 drives the carriage motor 6 to cause the carriage 1 to move along the platen 5 (Step 2). When the carriage 1 has reached a predetermined constant speed (Step 3), the load detection means 31 detects a load of the carriage motor 6 from the duty of a current pulse supplied to the carriage motor 6, and stores in the initial load storage means 32 the detected load as a reference load of the carriage at the time the recording head 2 is not in contact with the recording sheet (Step 4).

When the loading switch is pressed to load the recording sheet (Step 5), the recording sheet is set on the platen 5 by a loading mechanism (not shown) (Step 6). Then, the control means 46 instructs the motor drive means 30 to move the carriage 1 to substantially the center of the print region (Step 7) and temporarily drives the stepper motor 5 reversely to cause the carriage 1 to retreat in such a direction as to be opposite to the platen 5, i.e., toward the position detector 18. When the carriage 1 has reached the reference position as a result of this control, a signal is generated from the position detector 18, which causes the control means 46 to stop the stepper motor 10 (Step 8).

Figure 4:
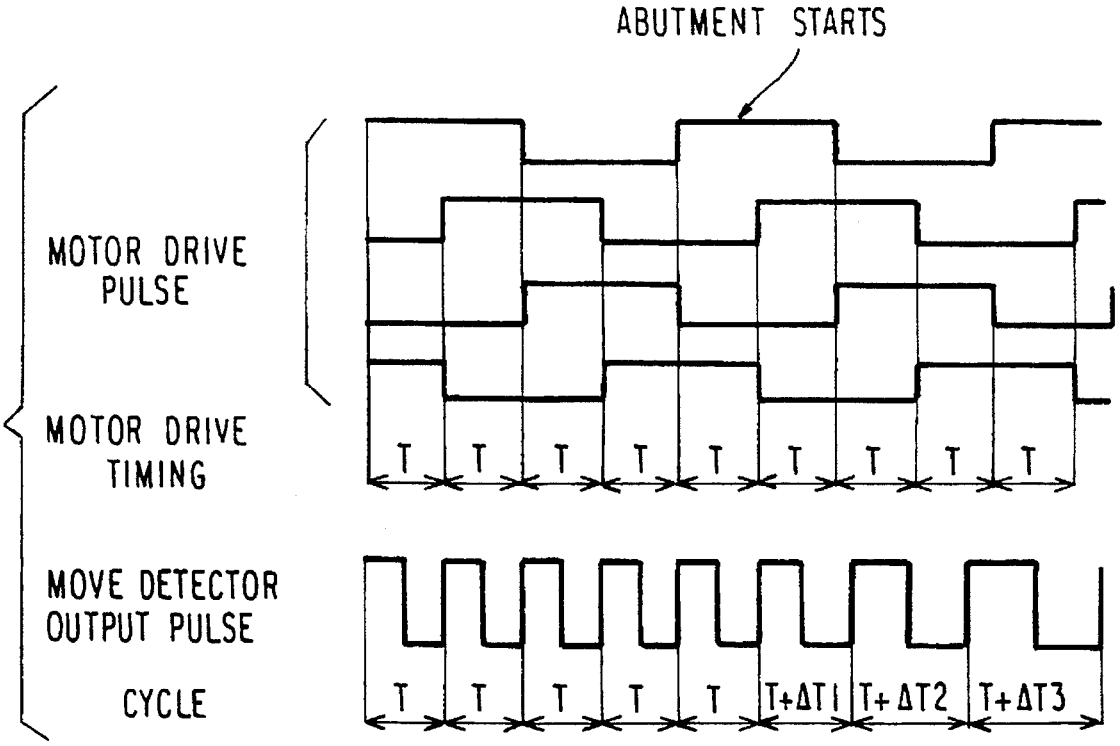
FIG. 4 is a waveform diagram showing the mode of operation of the embodiment shown in FIG. 2.

Then, the control means 46 forwardly drives the stepper motor 10 at a predetermined rotational speed to move the carriage 1 toward the platen 5 and, at the same time, counts the number of pulse signals from the first encoder 14. After the carriage 1 has made a movement equivalent to a predetermined number of pulses, the time difference detection means 41 judges whether a time difference is present between the drive pulse cycle of the stepper motor 10 and the pulse signal cycle of the rotary encoder 14. Since the load applied to the stepper motor 10 remains constant until the recording head 2 is abutted against the recording sheet, there is no time difference between the cycle of each pulse signal from the rotary encoder 14 and the drive pulse cycle of the stepper motor 10 during this period and, therefore, the integrated value thereof remains equal to zero (FIG. 4) (Step 9).

Figure 5:
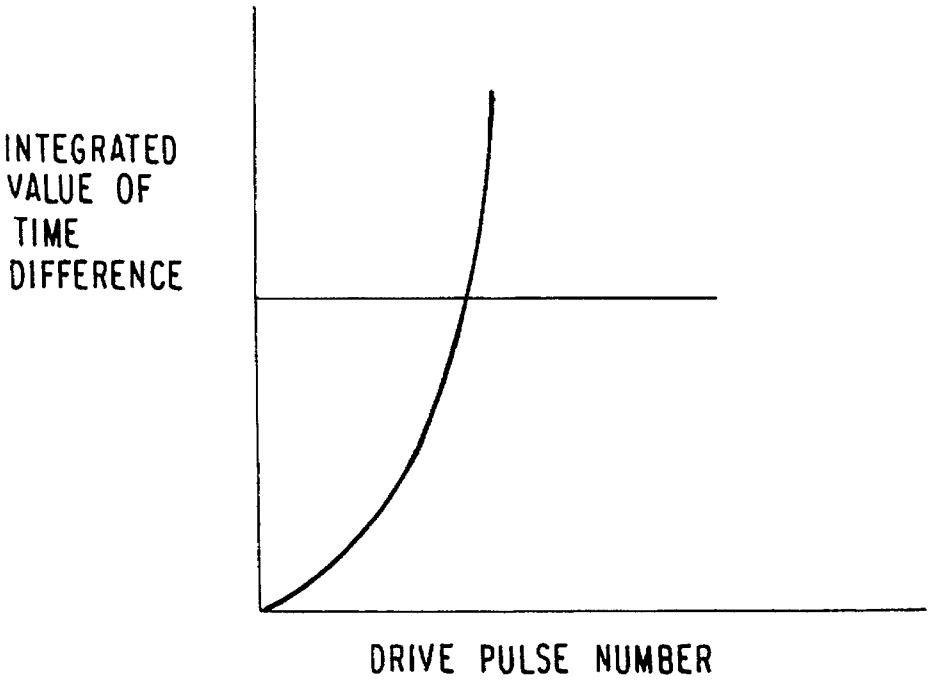
FIG. 5 is a diagram showing a change in the integrated value of time differences when the recording head starts being abutted against a recording sheet.

As the carriage 1 further moves toward the platen 5, the recording head 2 starts to abut against the recording sheet, which in turn decreases the rotational speed of the first encoder 14 because the load is applied to the carriage 1. As a result, the cycle of each pulse signal from the encoder 14 is increased to cause an amount of change AT to the time difference T with respect to the drive signal of the stepper motor 10. The time difference integration means 42 sequentially integrates such amounts of change $\Delta T$ in the time difference and delivers the integrated value to the abutment judgment means 43. The load of the stepper motor 10 increases with increasing distance of movement of the carriage 1 toward the platen 5 (FIG. 5), causing the integrated value $\Sigma$ ($\Delta T$) of the amounts of change $\Delta Tn$ in the time difference to increase so drastically as to reach the preset value (Step 10). Accordingly, the abutment judgment means 43 judges that the recording head 2 has been abutted against the recording sheet and thereby generates a signal that indicates the abutment.

The control means 46 stops the rotation of the stepper motor 10 upon reception of the signal from the abutment judgment means 43, whereas the sheet thickness calculation means 44 calculates the thickness of the recording sheet by stopping the counting of pulses from the first encoder 14 based on the signal from the abutment judgment means 43 (Step 11). The control means 46 causes the carriage 1 to retreat from the platen 5 and fixes the carriage 1 at an optimal position by driving the stepper motor 10 based on the calculated sheet thickness so that an optimal gap length can be given to the recording sheet (Step 12).

After the adjustment of the platen gap, the control means 46 causes the carriage 1 to move in parallel with the platen 5 by driving the carriage motor 6 again (Step 13). When the carriage 1 has reached the constant speed (Step 14), the load detection means 31 detects a load required for driving the carriage 1 based on the duty of a current pulse that drives the carriage motor 6 (Step 15). The contact judgment means 33 calculates a difference between a currently detected-load and the load stored in the initial load storage means 32 (Step 16). If the calculated difference is smaller than the reference value (Step 16), then the printer, being ready to print, is set to a stand-by mode.

On the other hand, if the calculated difference is larger than the reference value (Step 17), then the control means 46, recognizing that the carriage 1 has a high travel resistance due to the recording head 2 and the ink ribbon being in contact with the recording sheet, increases the platen gap by applying a drive pulse to the stepper motor 10 so that the carriage 1 makes a retreat equivalent to a predetermined distance, e.g., a single step, from the platen 5 (Step 18). The control means 46 then drives the carriage motor 6 again to move the carriage 1 along the length of the shaft of the platen 5 (Step 19). Then, when the carriage 1 has reached the constant speed (Step 20), the load of the carriage motor 6 is detected (Step 21) and a difference between the detected load and the load in the initial load storage means 32 is calculated (Step 21). If the difference is smaller than the reference value (Step 22), the printer is set to the stand-by mode with the adjusted platen gap and waits for a print data input. On the other hand, if the load has not decreased in spite of the platen gap readjustment (Step 22), then the control means 46 ejects the recording sheet by judging the recording sheet loading as being erroneous (Step 23), and gives an alarm to the user for inspection as necessary.

Although the load of the carriage motor is measured every time a load is applied to the carriage motor in the aforementioned embodiment, a similar effect can be obtained by storing a load as a fixed value.

Further, although the reference position detection means 18 is arranged to set the reference position in the aforementioned embodiment, it is apparent that a similar effect can be obtained by measuring the distance between an arbitrary carriage position and the platen surface by the carriage to retreat to the original position, and then calculating the distance by which the carriage is abutted against the recording sheet after loading the recording sheet onto the platen.

Figure 6:
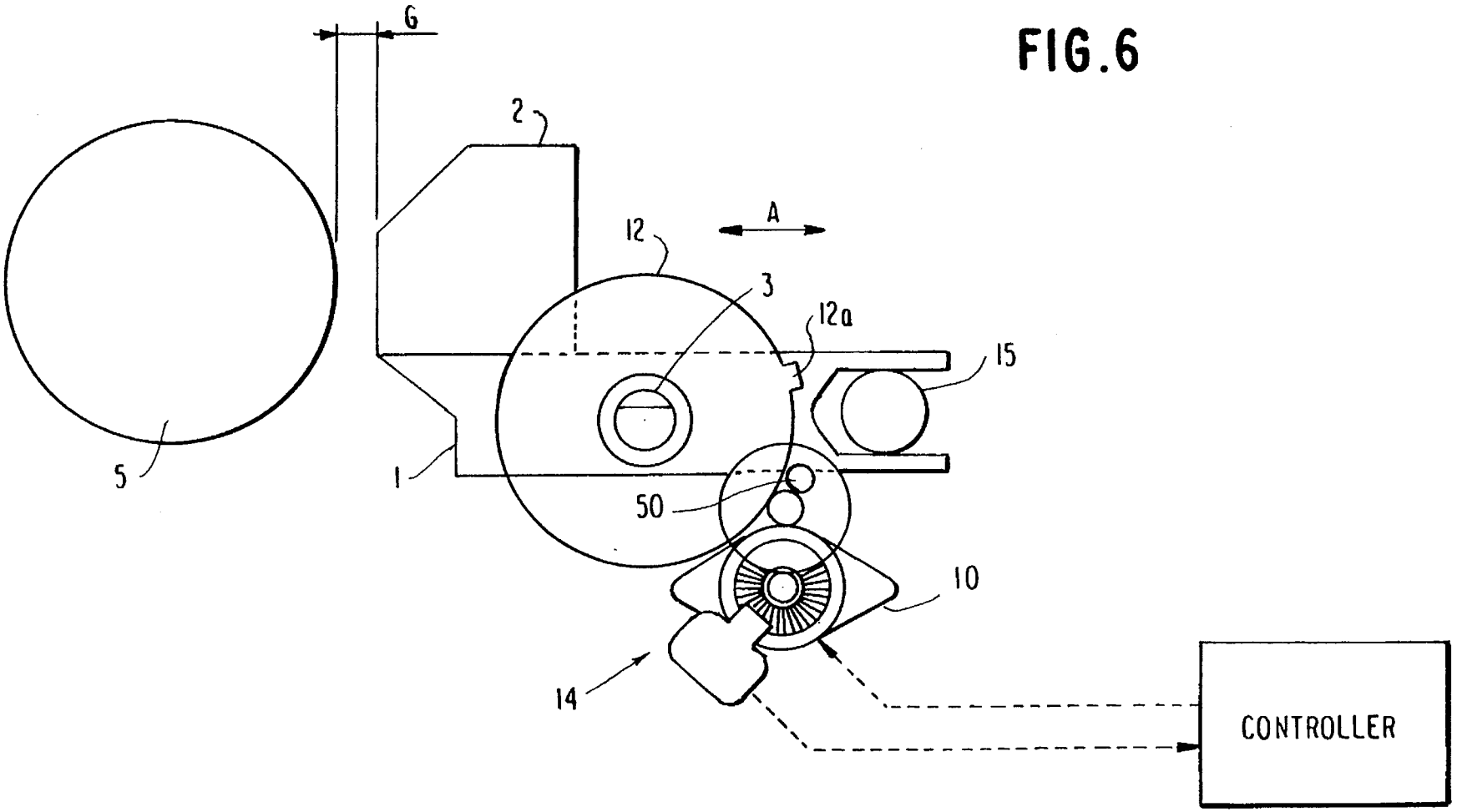
FIG. 6 is an end view and diagram of another embodiment of the invention.

It is also apparent that a similar effect can be obtained by arranging, as shown in FIG. 6, a means for driving the carriage 1, e.g., a positioning projection 12*a* on the driven wheel 12, and a positioning pin 50 on the stationary side and causing these means to mechanically set the reference.

It is further apparent that while the amount of movement of the carriage 1 toward the platen and the speed of the carriage are detected by the rotary encoders in this embodiment, a similar effect can be obtained by using a linear detector such as a magnet scale that converts a linear distance into a number of pulses.

It is still further apparent that while this embodiment is designed to synchronize the drive signal of the carriage driving stepper motor with the pulse signal of the rotary encoder 14, a similar effect can be obtained by judging the movement of the carriage from the number of drive pulses within the cycle of the pulse signal of the rotary encoder 14 if the cycle of the drive signal is significantly smaller than the cycle of the pulse signal of the rotary encoder 14.

It is still further apparent that while the dedicated stepper motor is arranged to move the carriage in the direction orthogonal to the platen shaft in the aforementioned embodiment, a similar effect can be obtained by selectively connecting the carriage motor through a transmission mechanism.

It is still further apparent that while the dc motor is used to drive the carriage in the aforementioned embodiment, a similar effect can be obtained by using a pulse motor.

As described in the foregoing, the invention is characterized as including: a means for detecting a load from a load current of a carriage motor when a carriage is moved in parallel with a platen shaft at a predetermined speed; an initial load storage means for storing a load at the time a recording sheet is not loaded as an initial load; a contact judgment means for comparing a load at the time the recording sheet is loaded with the initial load, and judging that the recording head is in contact with the recording sheet when a difference between both loads exceeds a reference value; a stepper motor for moving the carriage in a direction orthogonal to the platen shaft; a movement amount detection means for generating a number of pulse signals proportional to an amount of movement of the carriage in the direction orthogonal to the platen shaft; an abutment judgment means for moving the carriage toward the platen from a reference position, integrating time differences between respective drive pulses of the stepper motor and corresponding pulse signals generated from the movement amount detection means as a result of the drive of the stepper motor by the drive pulses, and thereby judging that the integrated value of the time differences has reached a predetermined value; a sheet thickness calculation means for calculating the thickness of a recording sheet based on the amount of movement of the carriage from the reference position upon output of a signal from the abutment judgment means; and a control means for adjusting a relative gap length between the carriage and the platen by driving the stepper motor based on data of the sheet thickness calculation means. Therefore, the platen gap can be set to an optimal value by judging the time upon which the recording head has been abutted against the recording sheet without applying an unnecessarily large force to the recording sheet. Moreover, breakage and staining of the recording head due to defective loading of a recording sheet can be prevented by checking whether there is contact between the recording head and the recording sheet after the platen gap has been set.

What is claimed is:

1. An automatic platen gap adjusting device for a printer, comprising:

a carriage motor for driving a carriage in parallel with a platen shaft, the carriage carrying a recording head;

means for detecting a load from a load current of the carriage motor when the carriage is moved in parallel with the platen shaft at a predetermined speed;

initial load storage means for storing an initial load before a recording sheet is inserted in the printer;

contact judgment means for comparing a load at the time the recording sheet is inserted in the printer with the initial load and for judging whether or not the recording head is in contact with the recording sheet when a difference between these loads exceeds a reference value;

a stepper motor for moving the carriage in a direction orthogonal to the platen shaft;

movement amount detection means for generating a number of pulse signals proportional to an amount of movement of the carriage in the direction orthogonal to the platen shaft;

abutment judgment means for integrating time differences between respective drive pulses of the stepper motor and corresponding pulse signals generated from the movement amount detection means as a result of the drive of the stepper motor by the drive pulses, and for judging whether or not the integrated value of the time differences has reached a predetermined value;

sheet thickness calculation means for calculating a thickness of the recording sheet based on the amount of movement of the carriage from a reference position upon output of a signal from the abutment judgment means indicating that the integrated value of the time differences has reached the predetermined value; and control means for adjusting a relative gap length between the carriage and the platen by driving the stepper motor based on data from the sheet thickness calculation means.

2. The automatic platen gap adjusting device for a printer according to claim 1, wherein said control means comprises means for causing the carriage to retreat from the platen by driving the stepper motor by a predetermined amount upon detection of contact between the recording head and the recording sheet by the contact judgment means.

3. The automatic platen gap adjusting device as recited in claim 1, wherein said movement amount detection means comprises a rotary encoder.

4. The automatic platen gap adjusting device as recited in claim 1, wherein said movement amount detection means comprises a linear encoder.

5. An automatic platen gap adjusting device for a printer, the printer comprising a carriage motor for driving a carriage in parallel with a platen shaft, the carriage carrying a recording head, and a gap adjusting motor for adjusting a relative gap length between the carriage and a platen by moving the carriage in a direction orthogonal to the platen shaft, wherein the automatic platen gap adjusting device comprises:

means for detecting a load applied to the carriage motor when the carriage is moved in parallel with the platen shaft at a predetermined speed;

initial load storage means for storing an initial load before a recording sheet is inserted into printer;

contact judgment means for comparing a load at the time the recording sheet is inserted in the printer with the initial load and for judging whether or not the recording head is in contact with the recording sheet when a difference between these loads exceeds a reference value; and control means for causing the carriage to retreat from the platen by driving the gap adjusting motor by a predetermined amount upon detection of contact between the recording head and the recording sheet by the contact judgment means.

6. An automatic platen gap adjusting device for a printer, comprising:

a carriage motor for driving a carriage in parallel with a platen shaft, the carriage carrying a recording head;

means for detecting a load from a load current of the carriage motor when the carriage is moved in parallel with the platen shaft at a predetermined speed;

initial load storage means for storing an initial load before a recording sheet is inserted in the printer;

contact judgment means for comparing a load at the time the recording sheet is inserted in the printer with the initial load and for judging whether or not the recording head is in contact with the recording sheet when a difference between these loads exceeds a reference value;

a stepper motor for moving the carriage in a direction orthogonal to the platen shaft;

movement amount detection means for generating a number of pulse signals proportional to an amount of movement of the carriage in the direction orthogonal to the platen shaft;

abutment judgment means for judging when the carriage first contacts one of the platen and the recording sheet by determining whether a number of drive pulses of the stepper motor within a cycle of the pulse signals of the movement amount detection means has reached a predetermined value;

sheet thickness calculation means for calculating a thickness of the recording sheet based on the amount of movement of the carriage from a reference position upon output of a signal from the abutment judgment means indicating that the predetermined value has been reached; and control means for adjusting a relative gap length between the carriage and the platen by driving the stepper motor based on data from the sheet thickness calculation means.

7. An automatic platen gap adjusting device for a printer, the printer comprising a carriage motor for driving a carriage in parallel with a platen shaft, the carriage carrying a recording head, and a gap adjusting motor for adjusting a relative gap length between the carriage and a platen by moving the carriage in a direction orthogonal to the platen shaft, wherein the automatic platen gap adjusting device comprises:

movement amount detection means for generating a number of pulse signals proportional to an amount of movement of the carriage in the direction orthogonal to the platen shaft;

abutment judgment means for integrating time differences between respective drive pulses of the gap adjusting motor and corresponding pulse signals generated from the movement amount detection means as a result of the drive of the gap adjusting motor by the drive pulses, and for judging whether or not the integrated value of the time differences has reached a predetermined value;

sheet thickness calculation means for calculating a thickness of the recording sheet based on the amount of movement of the carriage from a reference position upon output of a signal from the abutment judgment means indicating that the integrated value of the time differences has reached the predetermined value; and control means for adjusting a relative gap length between the carriage and the platen by driving the gap adjusting motor based on data from the sheet thickness calculation means.

8. An automatic platen gap adjusting device as recited in claim 7, further comprising position detection means for setting the reference position of the carriage.

9. An automatic platen gap adjusting device as recited in claim 8, wherein said position detection means comprises a microswitch.

10. An automatic platen gap adjusting device as recited in claim 8, wherein said position detection means comprises a moving positioning projection associated with said carriage, said moving positioning projection contacting a stationary positioning pin at the reference position.

11. An automatic platen gap adjusting device for a printer, the printer comprising a carriage motor for driving a carriage in parallel with a platen shaft, the carriage carrying a recording head, and a gap adjusting motor for adjusting a relative gap length between the carriage and a platen by moving the carriage in a direction orthogonal to the platen shaft, wherein the automatic platen gap adjusting device comprises:

movement amount detection means for generating a number of pulse signals proportional to an amount of movement of the carriage in the direction orthogonal to the platen shaft;

abutment judgment means for judging when the carriage first contacts one of the platen and the recording sheet by determining whether a number of drive pulses of the gap adjusting motor within a cycle of the pulse signals of the movement amount detection means has reached a predetermined value;

sheet thickness calculation means for calculating a thickness of the recording sheet based on the amount of movement of the carriage from a reference position upon output of a signal from the abutment judgment means indicating that the predetermined value has been reached; and control means for adjusting a relative gap length between the carriage and the platen by driving the gap adjusting motor based on data from the sheet thickness calculation means.

12. An automatic platen gap adjusting device as recited in claim 11, further comprising position detection means for setting the reference position of the carriage.

13. An automatic platen gap adjusting device as recited in claim 12, wherein said position detection means comprises a microswitch.

14. An automatic platen gap adjusting device as recited in claim 12, wherein said position detection means comprises a moving positioning projection associated with said carriage, said moving positioning projection contacting a stationary positioning pin at the reference position.

* * * * *